US010732525B2

(12) United States Patent
Shimada et al.

(10) Patent No.: US 10,732,525 B2
(45) Date of Patent: Aug. 4, 2020

(54) ELECTROPHOTOGRAPHIC APPARATUS

(71) Applicant: CANON KABUSHIKI KAISHA, Tokyo (JP)

(72) Inventors: Tsuyoshi Shimada, Kashiwa (JP); Kan Tanabe, Matsudo (JP); Haruhiko Mitsuda, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/387,422

(22) Filed: Apr. 17, 2019

(65) Prior Publication Data

US 2019/0332022 A1 Oct. 31, 2019

(30) Foreign Application Priority Data

Apr. 25, 2018 (JP) ..... 2018-083815
Apr. 4, 2019 (JP) ..... 2019-072249

(51) Int. Cl.

*G03G 5/047* (2006.01)
*G03G 15/01* (2006.01)
*G03G 5/07* (2006.01)
*G03G 5/06* (2006.01)

(52) U.S. Cl.

CPC ..... *G03G 5/047* (2013.01); *G03G 5/078* (2013.01); *G03G 15/0189* (2013.01); *G03G 5/0622* (2013.01)

(58) Field of Classification Search

CPC ..... G03G 7/0053
See application file for complete search history.

(56) References Cited

U.S. PATENT DOCUMENTS

2006/0188798 A1* 8/2006 Tokutake ..... G03G 5/144 430/60
2013/0051840 A1* 2/2013 Yamamoto ..... G03G 15/0817 399/102

FOREIGN PATENT DOCUMENTS

JP 2007233355 A 9/2007
JP 2009058603 A 3/2009
JP 2015-152640 * 8/2015 ..... G03G 5/147
JP 2016224348 A 12/2016

OTHER PUBLICATIONS

Translation of JP 2015-152640.*

* cited by examiner

*Primary Examiner* — Peter L Vajda
(74) *Attorney, Agent, or Firm* — Canon U.S.A., Inc. I.P. Division

(57) ABSTRACT

An electrophotographic apparatus includes an electrophotographic photosensitive member, a charging roller disposed so as to come into contact with the electrophotographic photosensitive member, and a charging device operable to apply only a DC voltage to charge the electrophotographic photosensitive member. The electrophotographic photosensitive member includes a support member, an undercoat layer over the support member, and a photosensitive layer over the undercoat layer and having a plurality of discrete recesses in the surface thereof. The undercoat layer contains zinc oxide particles and a binder resin. The undercoat layer has cavities therein, and the cavities account for 5.00% or less of the volume of the undercoat layer.

5 Claims, 7 Drawing Sheets

ELECTROPHOTOGRAPHIC APPARATUS

BACKGROUND OF THE INVENTION

Field of the Invention

The present disclosure relates to an electrophotographic apparatus.

Description of the Related Art

There have widely been used electrophotographic apparatuses adapted for contact charge in which the electrophotographic photosensitive member is electrically charged by applying a voltage to a charging member (contact charging member) in contact with the electrophotographic photosensitive member.

Among such contact charge electrophotographic apparatuses the mainstream is a type using a charging roller, which is a type of charging member in the form of a roller, in such a manner that a voltage is applied to the charging roller in contact with the surface of the electrophotographic photosensitive member. In this instance, the charging is performed by applying a voltage obtained by superimposing an AC voltage on a DC voltage (AC/DC contact charge) or by applying only a DC voltage (DC contact charge).

DC contact charge is superior to AC/DC contact charge in terms of lifetime of the electrophotographic photosensitive member (Japanese Patent Laid-Open No. 2016-224348). In DC contact charge, the amount of discharge from the charging member to the electrophotographic photosensitive member is small and, accordingly, the surface of the electrophotographic photosensitive member is not much worn down.

The electrophotographic photosensitive member undergoes external mechanical force from various members in contact therewith, as well as the electrical force such as charging voltage, thus causing various problems. One of the approaches to overcoming such problems is to roughen the surface layer of the electrophotographic photosensitive member.

Japanese Patent Laid-Open No. 2007-233355 disclosed a technique to roughen the surface of the electrophotographic photosensitive member by forming discrete recesses in the surface.

The discrete recesses in the surface of the electrophotographic photosensitive member function to reduce friction with the cleaning blade. Thus, such an electrophotographic photosensitive member is more likely than the case of having an indefinite surface profile to keep the surface profile over a long time, and the electrophotographic apparatus using such an electrophotographic photosensitive member can be more stable.

In another approach, metal oxide particles are added into the undercoat layer of the electrophotographic photosensitive member.

In Japanese Patent Laid-Open No. 2009-58603, zinc oxide particles are used as the metal oxide particles because the use of zinc oxide particles reduces changes in electrical properties and suppresses ghosting, thus being expected to further improve the electrophotographic apparatus.

SUMMARY OF THE INVENTION

An electrophotographic apparatus according to an embodiment of the present disclosure includes an electrophotographic photosensitive member, a charging roller disposed so as to come into contact with the electrophotographic photosensitive member, and a charging device operable to apply only a DC voltage to charge the electrophotographic photosensitive member. The electrophotographic photosensitive member includes a support member, an undercoat layer over the support member, and a photosensitive layer over the undercoat layer and has a plurality of discrete recesses in the surface thereof. The undercoat layer contains zinc oxide particles and a binder resin. The undercoat layer has cavities therein, and the cavities account for 5.00% or less of the volume of the undercoat layer.

Further features and aspects of the present invention will become apparent from the following description of example embodiments with reference to the attached drawings.

DESCRIPTION OF THE EMBODIMENTS

Figure 1:
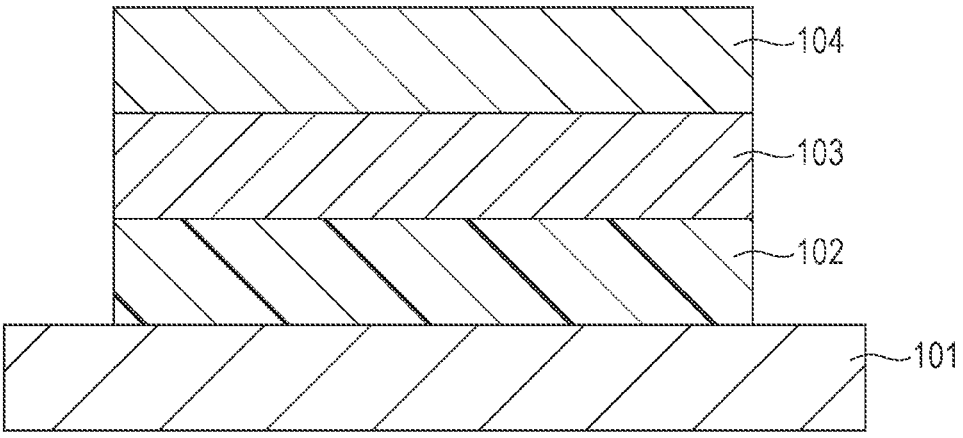
FIG. 1 is a schematic diagram of the structure of an electrophotographic photosensitive member used in an electrophotographic apparatus according to an example embodiment of the present disclosure.
Figure 2A:
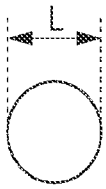
FIGS. 2A to 2J are illustrative representations of example shapes of the open ends of recesses formed in the surface of the electrophotographic photosensitive member.
Figure 2B:
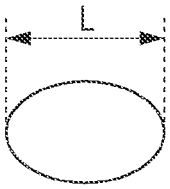
Figure 2C:
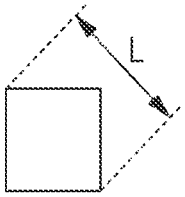
Figure 2D:
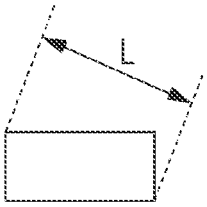
Figure 2E:
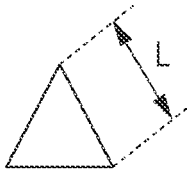
Figure 2F:
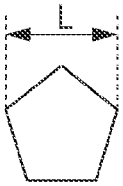
Figure 2G:
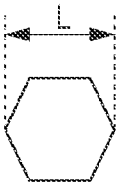
Figure 2H:
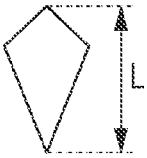
Figure 2I:
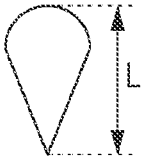
Figure 2J:
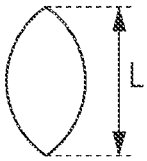
Figure 3A:
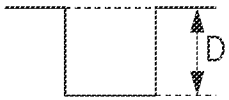
FIGS. 3A to 3H are illustrative representations of example shapes of the sections taken in the depth direction of the recesses formed in the surface of the electrophotographic photosensitive member.
Figure 3B:
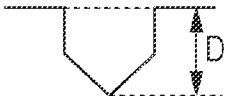
Figure 3C:
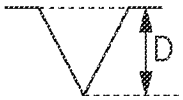
Figure 3D:
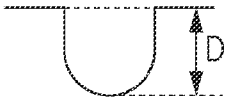
Figure 3E:
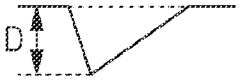
Figure 3F:
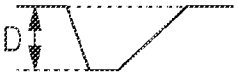
Figure 3G:
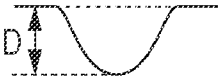
Figure 3H:
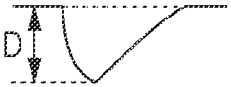

Although the techniques disclosed in the above-cited documents are expected to provide a long-life, stable, high-quality electrophotographic apparatus, the present inventors found through their studies that such electrophotographic apparatuses have a disadvantage in terms of leakage in the electrophotographic photosensitive member.

Accordingly, the present disclosure provides an electrophotographic apparatus that is unlikely to cause leakage and includes an electrophotographic photosensitive member and a charging device operable to apply only a DV voltage to electrically charge the electrophotographic photosensitive member. The electrophotographic photosensitive member has discrete recesses in the surface thereof and includes an undercoat layer containing zinc oxide particles.

The electrophotographic apparatus of the present disclosure will now be described in detail. The electrophotographic photosensitive member used in the electrophotographic apparatus of the present disclosure includes a support member, an undercoat layer disposed over the support member, and a photosensitive layer disposed over the undercoat layer, and the surface of the electrophotographic photosensitive member has a plurality of discrete recesses. The undercoat layer has cavities therein. The cavities account for 5.00% or less of the volume of the undercoat layer (the cavity volume ratio is 5.00% or less).

It has been found that a structure of the electrophotographic photosensitive member unlikely to cause electrical leakage for the type of electrophotographic apparatus including an electrophotographic photosensitive member having discrete recesses in the surface thereof and including an undercoat layer containing zinc oxide particles, and a charging device operable to apply only a DC voltage to electrically charge the electrophotographic photosensitive member. The structure is such that the undercoat layer has cavities therein that account for 5.00% or less of the volume of the undercoat layer.

DC contact charge may be disadvantageous for suppressing leakage in some cases, and recesses in the surface of the electrophotographic photosensitive member, which form locally thin portions, may also be disadvantageous for suppressing leakage in some cases. Furthermore, the cavities in the undercoat layer of the electrophotographic photosensitive member break the electrically conducting path in the undercoat layer and thus cause flowing charges to be concentrated. The present inventors think that the cavities are thus disadvantageous for suppressing leakage.

The present inventors believe that, in the case of DC contact charging electrophotographic apparatus including an electrophotographic photosensitive member having recesses in the surface thereof, leakage can be reduced when the cavities account for 5.00% or less of the volume of the undercoat layer (this percentage of the cavities relative to the volume of the undercoat layer is hereinafter referred to as cavity volume ratio). In addition, when the cavity volume ratio of the undercoat layer is 0.05% or more, development becomes likely to be performed at a constant potential. Although the reason for this is not clearly known, the inventors thought that the cavities in the undercoat layer have a larger polarization component than the other portion of the undercoat layer, and that the polarization component reduces a difference in charged potential between the recesses and the other portion in the surface of the electrophotographic photosensitive member that may be caused by DC contact charge, and thus uniformizes the potential at the developing position.

In addition, when the cavity volume ratio of the undercoat layer is 0.46% to 1.99%, development becomes likely to be performed at a constant potential while leakage is being kept suppressed.

The cavity volume ratio mentioned herein is estimated by Stereology from the ratio (sectional cavity ratio) of the area of cavities at a section of the undercoat layer to the total area of the section. The cavity volume ratio, which is considered to be equal to the sectional cavity ratio, is calculated by using the following equation:

$$\Sigma A1/A2=Ar=\Sigma V1/V2=Vr$$

wherein ΣA1 represents the sum of the areas of cavities at a section, A2 represents the area of the section, Ar represents the sectional cavity ratio, ΣV1 represents the sum of the volumes of cavities in volume V2, V2 represents a volume, and Vr represents the cavity volume ratio, which may be multiplied by 100 for representation in percentage.

More specifically, cavity volume ratios mentioned herein are calculated as described below. First, an electrophotographic photosensitive member to be subjected to measurement of cavity volume ratio is cut into a cube of about 1 cm edge, and the cube was coated with a UV-curable acrylic resin, followed by curing the resin. Then, the cube is subjected to ion milling for 4 hours with an ion milling apparatus IM4000PLUS (manufactured by Hitachi High-Technologies) at an acceleration voltage of 4 kV and a discharge voltage of 1.5 kV to yield a section sample. The sample is then photographed at a magnification of 3000 times at an acceleration voltage of 5.0 kV under an ultrahigh resolution field emission scanning electron microscope SU8220 (manufactured by Hitachi High-Technologies) to yield a secondary electron image (SEM image) of the section of the sample. The outlines of the cavities are extracted from the taken image by using in image analysis software program Image J (developed by Wayne Rasband) and are then binarized to form an image where only the cavity regions are colored. The area of the cavity regions in the image is calculated by using the particle analysis function of Image J and, thus, the cavity volume ratio is calculated from the above equation. For calculation of the cavity volume ratio, an image (SEM image) including 100 or more cavities is used for the image analysis. If the number of cavities in an image to be analyzed is less than 100, two or more images are used for the calculation.

The undercoat layer of the electrophotographic photosensitive member used in the electrophotographic apparatus according to the present disclosure contains zinc oxide particles and a binder resin. The zinc oxide particles may be surface-treated if necessary. A variety of surface treatment techniques are known. For example, the surfaces of the zinc oxide particles may be subjected to adsorption of or reaction with a surface treating agent or may be moisturized by being exposed to a water vapor atmosphere. Such surface treatment techniques may be combined. A silane coupling agent may be used as the surface treating agent.

Examples of the silane coupling agent include N-2-(aminoethyl)-3-aminopropylmethyldimethoxysilane, 3-aminopropylmethyldimethoxysilane, (phenylaminomethyl)methyldimethoxysilane. N-2-(aminoethyl)-3-aminoisobutylmethyldimethoxysilane, N-ethylaminoisobutylmethyldimethoxysilane, N-methylaminopropylmethyldimethoxysilane, vinyltrimethoxysilane, 3-aminopropyltriethoxysilane, N-(2-aminoethyl)-3-aminopropyltrimethoxysilane, methyltrimethoxysilane, 3-glycidoxypropyltrimethoxysilane, 3-methacryloxypropyltrimethoxysilane, 3-chloropropyltrimethoxysilane, and 3-mercaptopropyltrimethoxysilane. In some embodiments, an amino silane coupling agent having an amino group may be used.

The volume average particle size of the zinc oxide particles may be 1 nm to 500 nm.

Different types of zinc oxide particles, for example, surface-treated in different ways, having different specific surface areas, or having different volume average particle size may be mixed.

Examples of the binder resin used in the undercoat layer include acrylic resin, allyl resin, alkyd resin, ethyl cellulose resin, ethylene-acrylic acid copolymer, epoxy resin, casein resin, silicone resin, gelatin resin, phenol resin, butyral resin, polyacrylate resin, polyacetal resin, polyamide-imide resin, polyamide resin, polyallyl ether resin, polyimide resin, polyurethane resin, polyester resin, polyethylene resin, polycarbonate resin, polystyrene resin, polysulfone resin, polyvinyl alcohol resin, polybutadiene resin, and polypropylene resin. In some embodiments, polyurethane resin may be used.

In some embodiments of the electrophotographic apparatus of the present disclosure, the undercoat layer of the electrophotographic photosensitive member may contain an oxime compound represented by the following formula (i):

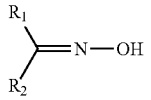

(i)

wherein R1 and R2 each represent a hydrogen atom or an alkyl group having a carbon number of 1 to 3, or R1 and R2 may form a ring.

The undercoat layer containing a certain amount of an oxime compound represented by formula (i) (hereinafter referred to as formula (i) oxime compound) may help further suppression of leakage. The content of the formula (i) oxime compound may be determined by gas chromatography using a headspace method in which the mass (g) of the formula (i) oxime compound is measured while the undercoat layer is heated at 200° C. for 60 minutes. The mass (g) of the oxime compound thus measured is divided by the mass (g) of the undercoat layer. The resulting quotient is defined as detection amount A. In some embodiments, detection amount A may be 0.0015% to 0.2400%. For adding the formula (i) oxime compound, the oxime compound may be added into a coating liquid for forming the undercoat layer, or a block copolymer of isocyanate and the formula (i) oxime compound may be used as the binder resin in the undercoat layer.

The electrophotographic photosensitive member of the electrophotographic apparatus of the present disclosure has discrete recesses in the surface thereof; The discrete recesses mentioned herein are those in a state where each recess is clearly distinguished from the other recesses.

The recesses in the surface of the electrophotographic photosensitive member may be observed with a microscope, such as a laser microscope, an optical microscope, an electron microscope, or an atomic force microscope. Recesses in a cylindrical electrophotographic photosensitive member will now be described by way of example.

Figure 8:
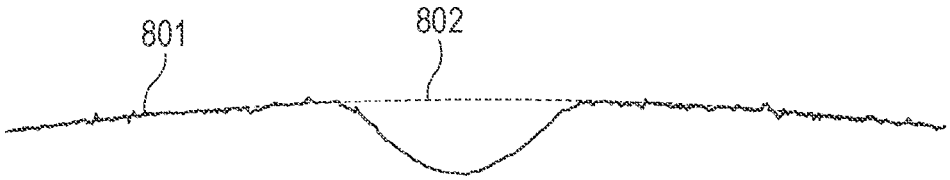
FIG. 8 is an illustrative representation of an example profile fitting.

First, the surface of the electrophotographic photosensitive member is observed under a microscope. The surface of the electrophotographic photosensitive member is curved in the circumferential direction, the profile at the section (section profile) of the curved surface is extracted, and the curve (segment of the surface) is subjected to profile fitting. FIG. 8 is an illustrative representation of profile fitting. FIG. 8 shows an example of a surface profile of a cylindrical electrophotographic photosensitive member. In FIG. 8, solid line 801 represents the profile of the surface (curved surface) at a cross section of an electrophotographic photosensitive member, and broken line 802 represents the curve fitted to the profile 801. The profile 801 is corrected so that the curve 802 is turned into a straight line, and the straight line is expanded in the longitudinal direction (perpendicular to the circumferential direction) of the electrophotographic photosensitive member to define a reference plane. In the case of a non-cylindrical electrophotographic photosensitive member, the reference plane is defined in the same manner as in the case of the cylindrical member.

Portions below the reference plane are defined as recesses.

The open end of each recess at the surface of the electrophotographic photosensitive member (when the surface of the electrophotographic photosensitive member is observed) can have various shapes that may be defined by, for example, straight-line segments, curved line segments, or straight-line and curved line segments.

Example shapes of the open end of the recesses are shown in FIG. 2A to 2J.

The longest of the line segments across the open end is defined as the width, and the width (denoted by L in FIGS. 2A to 2J) of the open end may be 10 μm to 200 μm.

Example shapes of the section taken in the depth direction of the recesses are shown in FIG. 3A to 3H. The section of the recesses can have various shapes as shown in FIG. 3A to 3H.

The distance from the reference plane at a recess to the bottom of the recess is defined as the depth of the recess. In some embodiments, the depth (denoted by D in FIGS. 3A to 3H) may be 3.0 μm or less from the viewpoint of keeping the development potential of the electrophotographic apparatus constant.

The recesses in the surface of an electrophotographic photosensitive member may all have the same shape, depth and open end width, or recesses varied in shape, depth, or open end width may be combined.

Formation of Recesses in Periphery of Electrophotographic Photosensitive Member

The recesses may be formed in the surface or periphery of the electrophotographic photosensitive member by pressing a mold having protrusions corresponding to the recesses on the periphery to transfer the profile of the mold.

Figure 6:
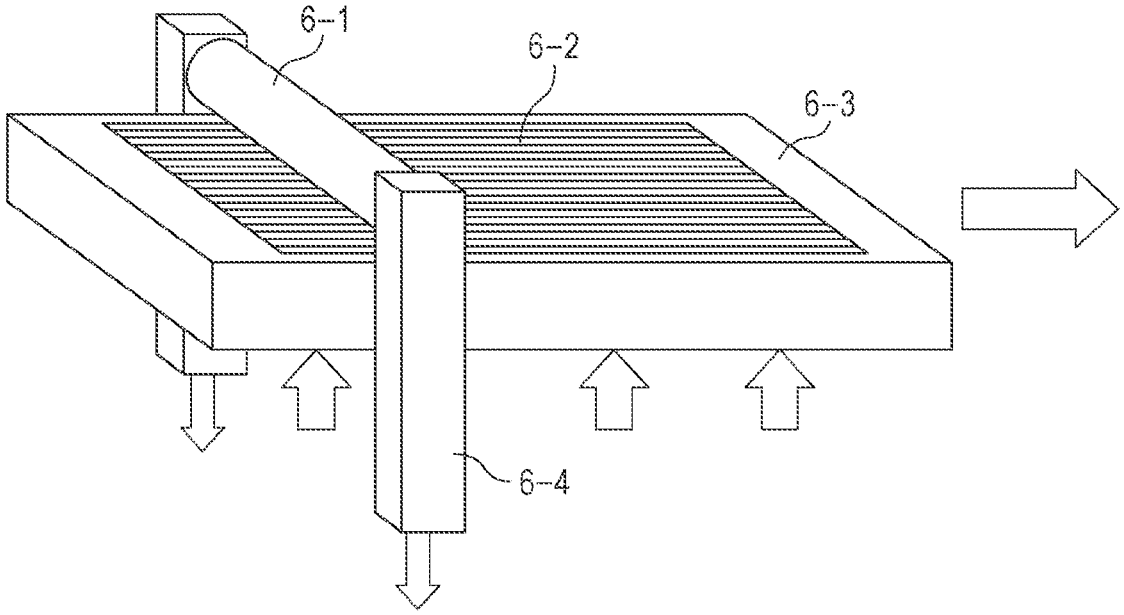
FIG. 6 is an illustrative representation of a pressure contact-type profile transfer apparatus used to form recesses in the periphery of an electrophotographic photosensitive member.

FIG. 6 shows a pressure contact-type profile transfer apparatus used to form the recesses in the periphery of the electrophotographic photosensitive member. The pressure contact-type profile transfer apparatus shown in FIG. 6 is operable to bring a mold 6-2 into contact with the periphery of a rotating electrophotographic photosensitive member 6-1 that is an object to be processed and to press the mold on the photosensitive member, thus forming recesses in the periphery and a flat surface at the periphery of the electrophotographic photosensitive member 6-1.

The pressing member 6-3 of the profile transfer apparatus is made of, for example, a metal, a metal oxide, plastic, or glass. In view of mechanical strength, dimensional accuracy, and durability, the pressing member is often made of stainless steel (SUS). The mold 6-2 is disposed on the upper surface of the pressing member 6-3. The pressing member 6-3 is also provided with a support member (not shown) and a press system (not shown) below the lower surface thereof so as to enable the mold 6-2 to come into contact with the periphery of the electrophotographic photosensitive member 6-1, which is held by a holding member, at a predetermined pressure. In this instance, the holding member 6-4 or both the pressing member 6-3 and the holding member 6-4 may be moved so that the electrophotographic photosensitive member 6-1 can be pressed against the pressing member 6-3.

FIG. 6 illustrates an example in which the periphery of the electrophotographic photosensitive member 6-1 rotating or being rotated is continuously processed by transferring the pressing member 6-3 in a direction perpendicular to the axis direction of the electrophotographic photosensitive member 6-1. The periphery of the electrophotographic photosensitive member 6-1 may be continuously processed by moving the holding member 6-4 or moving both the holding member 6-4 and the pressing member 6-3 over the stationary pressing member 6-3 in a direction perpendicular to the axis direction of the electrophotographic photosensitive member 6-1.

From the viewpoint of efficient profile transfer, the mold 6-2 and/or the electrophotographic photosensitive member 6-1 may be heated. The mold 6-2 may be, for example, a metal or resin film having a finely processed surface, silicon wafer having a surface that has been subjected to patterning with a resist, a resin film in which fine particles are dispersed, or a metal-coated resin film having a fine surface profile.

From the viewpoint of uniformizing the pressure placed on the electrophotographic photosensitive member 6-1, an elastic member may be disposed between the mold 6-2 and the pressing member 6-3.

The electrophotographic apparatus of the present disclosure includes the electrophotographic photosensitive member, a charging roller disposed so as to come into contact with the electrophotographic photosensitive member, and a charging device operable to apply only a DC voltage to charge the electrophotographic photosensitive member.

Figure 4:
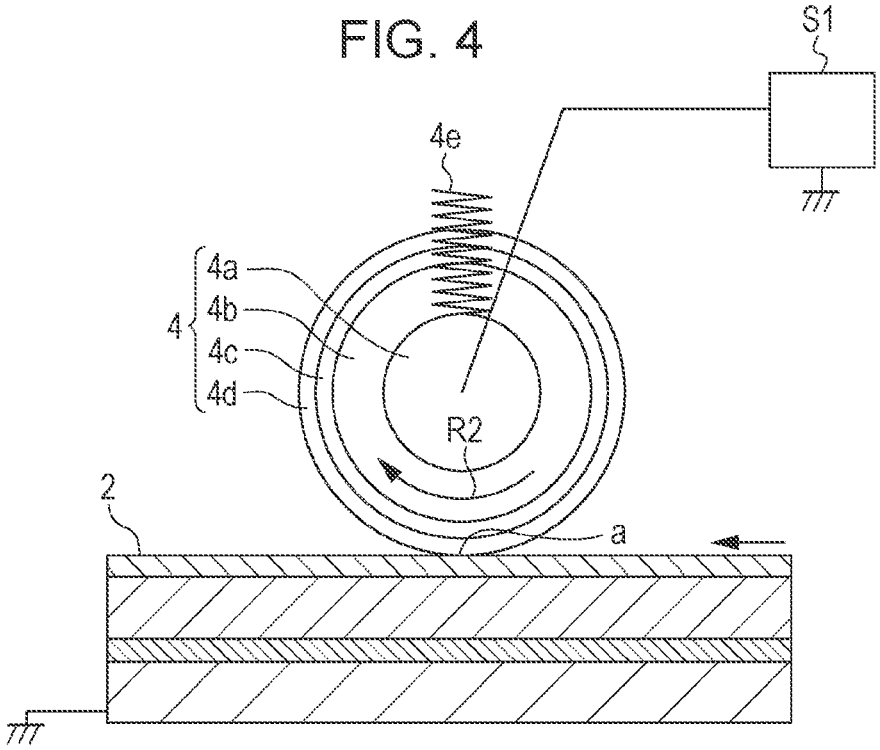
FIG. 4 is a schematic sectional view illustrating an example electrophotographic photosensitive member and a charging roller.

The charging roller may be as shown in FIG. 4. The charging roller shown in FIG. 4 includes a mandrel (support member) 4*a* and a three-layer structure around the mandrel. The three-layer structure includes an elastic layer 4*b*, an intermediate layer 4*c*, and a surface layer 4*d*, in this order, over the mandrel. The intermediate layer 4*c* is an optional member intended to control the resistance and separate the function of the surface layer. The structure around the mandrel may be defined by the elastic layer and the surface layer without the intermediate layer.

The lengths of the elastic layer 4*b*, the intermediate layer 4*c* and the surface layer 4*d* in the longitudinal direction of the charging roller 4 are in a range from the length of the image forming region of the electrophotographic photosensitive member 2 to the length of the generating line of the electrophotographic photosensitive member 2.

The elastic layer 4*b* may be formed of an elastic material, such as butadiene-based rubber, Hydrin rubber, ethylene propylene diene monomer (EPDM) rubber, or urethane rubber, in which electroconductive particles, such as metal oxide ($TiO_2$ or the like) particles or carbon black, are dispersed.

The surface layer 4*d* may be made of a composition containing a rubber, such as vinylidene fluoride-based rubber, tetrafluoroethylene-propylene rubber, epichlorohydrin rubber, acrylic rubber, or urethane rubber, and a binder, such as an acrylic resin or a fluororesin, in which electroconductive particles, such as carbon black or tin oxide particles, are dispersed.

The surface of the charging roller may be rough from the viewpoint of improving charging stability and suppressing contamination with toner. For forming a rough surface, roughening particles may be added into the surface layer, or the surface layer may be mechanically ground.

A cleaning member may be provided for the charging roller for removing dirt (toner and external additives of the toner, swarf of the electrophotographic photosensitive member) on the surface of the charging roller.

The cleaning member for the charging roller may be rotated by the rotation of the charging roller or by using a rotation driving system.

The cleaning member may be grounded, or a voltage may be applied to the cleaning member.

The cleaning member may be in the form of a brush (cleaning brush), a roller (cleaning roller), or a blade (cleaning blade).

The charging roller may be formed by, but not limited to, application of a paint containing desired constituents onto a surface by dipping or spraying, followed by drying and curing the applied paint. For a multilayer charging roller, paints or coating liquids for each layer may be applied and dried one after another to form a multilayer film.

For applying a charging bias, a DC voltage is applied to the charging roller 4 from a power supply S1 via the mandrel 4*a*. The power supply S1 includes a DC source having a control section. The control section is operable to control the DC source of the power supply S1 on/off for DV voltage application to the charging roller 4 and to control the DC voltage to be applied to the charging roller 4 from the DC source.

Electrophotographic Photosensitive Member

The structure of the electrophotographic photosensitive member of the electrophotographic apparatus of the present disclosure will now be described. The electrophotographic photosensitive member used in the present disclosure includes a support member, a photosensitive layer, and an undercoat layer between the support member and the photosensitive layer and has recesses in the surface thereof.

In the electrophotographic photosensitive member, the undercoat layer is disposed over the support member, and the photosensitive layer is disposed over the undercoat layer. The photosensitive layer may have a multilayer structure including a charge generating layer and a charge transport layer.

FIG. 1 shows the structure of an electrophotographic photosensitive member used in the electrophotographic apparatus of the present disclosure. The electrophotographic photosensitive member shown in FIG. 1 includes a support member 101, an undercoat layer 102, a charge generating layer 103, and a charge transport layer 104.

The electrophotographic photosensitive member may be produced by applying each of the coating liquids prepared for forming the respective layers, which will be described later, in a desired order, and drying the coatings. Each coating liquid may be applied by dip coating, spray coating, ink jet coating, roll coating, die coating, blade coating, curtain coating, wire bar coating, ring coating, or any other method. In an embodiment, dip coating may be employed from the viewpoint of efficiency and productivity.

Support Member

The electrophotographic photosensitive member disclosed herein includes a support member. In some embodiments, the support member may be electrically conductive. The support member may be in the form of a cylinder, a belt, a sheet, or the like. In some embodiments, a cylindrical support member may be used. The support member may be surface-treated by, for example, anodization or any other electrochemical technique, blasting, or cutting.

The support member may be made of a metal, a resin, or glass. For a metal support member, the metal may be selected from among aluminum, iron, nickel, copper, gold, stainless steel, and alloys thereof. In some embodiments, an aluminum support member may be used. If the support member is made of a resin or glass, an electrically conductive material may be added into or applied over the support member to impart an electrical conductivity.

Electroconductive Layer

An electroconductive layer may be disposed on the support member. The electroconductive layer covers surface flaws or surface roughness of the support member and reduces reflection of light from the surface of the support member.

The electroconductive layer may contain electrically conductive particles and a resin.

The material of the electrically conductive particles may be a metal oxide, a metal, carbon black, or the like.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

In some embodiments, the electroconductive particles may be made of a metal oxide, such as titanium oxide, tin oxide, or zinc oxide.

If metal oxide particles are used as the electrically conductive particles, these particles may be surface-treated with a silane coupling agent or the like or doped with an element such as phosphorus or aluminum or oxide thereof.

The electrically conductive particle may include a core particle and a coating layer coating the particle. The core particle may be made of titanium oxide, barium sulfate, zinc oxide, or the like. The coating layer may be made of a metal oxide, such as tin oxide.

If metal oxide particles are used as the electrically conductive particles, the metal oxide particles may have a volume average particle size of 1 nm to 500 nm, for example, 3 nm to 400 nm.

The resin contained in the electroconductive layer may be polyester resin, polycarbonate resin, polyvinyl acetal resin, acrylic resin, silicone resin, epoxy resin, melamine resin, polyurethane resin, phenol resin, or alkyd resin.

The electroconductive layer may further contain an opacity agent, such as silicone oil, resin particles, or titanium oxide.

The thickness of the electroconductive layer may be 1 μm to 50 μm, for example, 3 μm to 40 μm.

The electroconductive layer may be formed by applying an electroconductive layer-forming coating liquid containing the above-described constituents and a solvent to form a coating film, followed by drying the coating film. The solvent of the coating liquid may be an alcohol-based solvent, a sulfoxide-based solvent, a ketone-based solvent, an ether-based solvent, an ester-based solvent, or an aromatic hydrocarbon. The electrically conductive particles are dispersed in the electroconductive layer-forming coating liquid by using, for example, a paint shaker, a sand mill, a ball mill, or a high-speed liquid collision disperser.

Undercoat Layer

In an embodiment of the present disclosure, the undercoat layer is disposed on the support member or the electroconductive layer.

The undercoat layer contains zinc oxide particles and a binder resin, as described above. The undercoat layer has cavities, and the cavities account for 5.00% or less of the volume of the undercoat layer.

The undercoat layer may further contain an electron transporting material, a metal oxide, a metal, or an electrically conductive polymer from the viewpoint of increasing the electrical properties. In some embodiments, an electron transporting material or a metal oxide may be used.

Examples of the electron transporting material include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, and boron-containing compounds. The electron transporting material may have a polymerizable functional group so that the undercoat layer can be formed as a cured film by copolymerizing the electron transporting material and a monomer having a polymerizable functional group.

Examples of the metal oxide added to the undercoat layer include indium tin oxide, tin oxide, indium oxide, titanium oxide, aluminum oxide, and silicon dioxide. The metal added to the undercoat layer may be gold, silver, or aluminum.

Examples of the electron transporting material include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, and boron-containing compounds. In some embodiments, a benzophenone compound may be used.

The benzophenone compound may be expressed by the following formula (1):

(1)

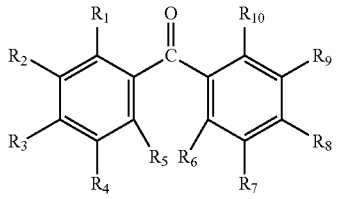

wherein R1 to R10 each represent a hydrogen atom, a hydrogen atom, a hydroxy group, an alkyl group, an alkoxy group, or an amino group.

The electron transporting material may have a polymerizable functional group so that the undercoat layer can be formed as a cured film by copolymerizing the electron transporting material and the above-described monomer having a polymerizable functional group.

The electrically conductive polymer may be polyaniline, polypyrrole, or polythiophene.

The undercoat layer may further contain organic resin particles or a leveling agent from the viewpoint of controlling the surface roughness thereof or reduce cracks therein. The organic resin particles may be hydrophobic organic particles, such as silicone particles, or hydrophilic organic particles, such as cross-linked poly(methyl methacrylate) (PMMA) particles. In particular, use of PMMA particles improves the adhesion of the undercoat layer to the overlying charge generating layer, leading to reduced variation in potential accompanying repeated use.

The leveling agent may be silicone oil or fluorine-based oil.

The average thickness of the undercoat layer may be 0.1 μm or more, for example, 0.2 μm or more or 0.3 μm or more. In some embodiments, the thickness of the undercoat layer may be 25.0 μm or more. Such an undercoat layer allows a reduced electric filed intensity to be applied thereto, thus effective in reducing leakage. The average thickness of the undercoat layer may be 50.0 μm or less, for example, 40.0 μm or less or 30.0 μm or less.

The undercoat layer may be formed by applying an undercoat layer-forming coating liquid containing the above-described constituents and a solvent to form a coating film, followed by drying and/or curing the coating film. The solvent of the undercoat layer-forming coating liquid may be an alcohol-based solvent, a ketone-based solvent, an ether-based solvent, an ester-based solvent, or an aromatic hydrocarbon.

Photosensitive Layer

In the embodiments of the present disclosure, a photosensitive layer is disposed over the undercoat layer.

The photosensitive layer of electrophotographic photosensitive members is generally classified into: (1) a multilayer photosensitive layer; or (2) a single-layer photosensitive layer. (1) The multilayer photosensitive layer includes a charge generating layer containing a charge generating material, and a charge transport layer containing a charge transporting material. (2) The single-layer photosensitive layer is a photosensitive layer containing a charge generating material and a charge transporting material together.

(1) Multilayer Photosensitive Layer

The multilayer photosensitive layer includes a charge generating layer and a charge transport layer. In some embodiments of the present disclosure, the photosensitive layer has such a multilayer structure. Hence, the multilayer photosensitive layer includes a charge generating layer and a charge transport layer.

(1-1) Charge Generating Layer

The charge generating layer may contain a charge generating material and a resin.

Examples of the charge generating material include azo pigments, perylene pigments, polycyclic quinone pigments, indigo pigments, and phthalocyanine pigments. Among these, azo pigments and phthalocyanine pigments are beneficial. In some embodiments, an oxytitanium phthalocyanine pigment, a chlorogallium phthalocyanine pigment, or a hydroxygallium phthalocyanine pigment may be used as the phthalocyanine pigment.

The charge generating material content in the charge generating layer may be 40% by mass to 85% by mass, for example, 60% by mass to 80% by mass, relative to the total mass of the charge generating layer.

Examples of the resin contained in the charge generating layer include polyester resin, polycarbonate resin, polyvinyl acetal resin, polyvinyl butyral resin, acrylic resin, silicone resin, epoxy resin, melamine resin, polyurethane resin, phenol resin, polyvinyl alcohol resin, cellulose resin, polystyrene resin, polyvinyl acetate resin, and polyvinyl chloride resin. In some embodiments, polyvinyl butyral resin may be used.

The charge generating layer may further contain one or e more additives, such as an antioxidant and a UV absorbent. Examples of such an additive include hindered phenol compounds, hindered amine compounds, sulfur compounds, phosphorus compounds, and benzophenone compounds.

The average thickness of the charge generating layer may be 0.1 μm to 1 μm, for example, 0.15 μm to 0.4 μm.

The charge generating layer may be formed by applying a charge generating layer-forming coating liquid containing the above-described constituents and a solvent to form a coating film, followed by drying the coating film. The solvent of the coating liquid may be an alcohol-based solvent, a sulfoxide-based solvent, a ketone-based solvent, an ether-based solvent, an ester-based solvent, or an aromatic hydrocarbon.

(1-2) Charge Transport Layer

The charge transport layer may contain a charge transporting material and a resin.

Examples of the charge transporting material include polycyclic aromatic compounds, heterocyclic compounds, hydrazone compounds, styryl compounds, enamine compounds, benzidine compounds, triarylamine compounds, and resins having a group derived from these compounds. In some embodiments, a triarylamine compound or a benzidine compound may be used.

The charge transporting material content in the charge transport layer may be 25% by mass to 70% by mass, for example, 30% by mass to 55% by mass, relative to the total mass of the charge transport layer.

The resin contained in the charge transport layer may be a polyester resin, a polycarbonate resin, an acrylic resin, or a polystyrene resin. In some embodiments, a polycarbonate resin or a polyester resin may be used. If a polyester resin is used, a polyarylate resin is beneficial.

The mass ratio of the charge transporting material to the resin may be 4:10 to 20:10, for example, 5:10 to 12:10.

The charge transport layer may further contain one or more additives, such as an antioxidant, a UV absorbent, a plasticizer, a leveling agent, a lubricant, and an abrasion resistance improver. More specifically, example additives include hindered phenol compounds, hindered amine compounds, sulfur compounds, phosphorus compounds, benzophenone compounds, siloxane-modified resin, silicone oil, fluororesin particles, polystyrene resin particles, polyethylene resin particles, silica particles, alumina particles, and boron nitride particles.

The average thickness of the charge transport layer may be 5 μm to 50 μm, for example, 8 μm to 40 μm or 10 μm to 30 μm.

In some embodiments, the total thickness of the charge transport layer and the layers overlying the charge transport layer may be 15.0 μm or more. In this instance, if the charge transport layer is the uppermost layer, the total thickness refers to the average thickness of the charge transport layer; if a protective layer is provided, the total thickness refers to the average total thickness of the charge transport layer and the protective layer.

The charge transport layer may be formed by applying a charge transport layer-forming coating liquid containing the above-described constituents and a solvent to form a coating film, followed by drying the coating film. The solvent of the charge transport layer-forming coating liquid may be an alcohol-based solvent, a ketone-based solvent, an ether-based solvent, an ester-based solvent, or an aromatic hydrocarbon. In some embodiments, an ether-based solvent or an aromatic hydrocarbon may be used as the solvent.

(2) Single-Layer Photosensitive Layer

The single-layer photosensitive layer may be formed by applying a coating liquid containing a charge generating material, a charge transporting material, a resin, and a solvent to form a coating film, followed by drying the coating film. The charge generating material, the charge transporting material, and the resin may be selected from among the same materials cited in "(1) Multilayer Photosensitive Layer".

Protective Layer

The photosensitive layer may be covered with a protective layer. The protective layer enhances durability.

The protective layer may contain electrically conductive particles and/or a charge transporting material and a resin.

The electrically conductive particles may be those of a metal oxide, such as titanium oxide, zinc oxide, tin oxide, or indium oxide.

Examples of the charge transporting material include polycyclic aromatic compounds, heterocyclic compounds, hydrazone compounds, styryl compounds, enamine compounds, benzidine compounds, triarylamine compounds, and resins having a group derived from these compounds. In some embodiments, a triarylamine compound or a benzidine compound may be used.

Examples of the resin contained in the protective layer include polyester resin, acrylic resin, phenoxy resin, polycarbonate resin, polystyrene resin, phenol resin, melamine resin, and epoxy resin. In some embodiments, a polycarbonate resin, a polyester resin, or an acrylic resin may be used.

The protective layer may be a cured film formed by polymerizing a composition containing a monomer having a polymerizable functional group. In this instance, a thermal polymerization reaction, a photopolymerization reaction, a radiation polymerization reaction, or the like may be made. The polymerizable functional group of the monomer may be an acryloyl group or a methacryloyl group. The monomer having a polymerizable functional group may have a charge transporting function.

The protective layer may further contain one or more additives, such as an antioxidant, a UV absorbent, a plasticizer, a leveling agent, a lubricant, and an abrasion resistance improver. More specifically, example additives include hindered phenol compounds, hindered amine compounds, sulfur compounds, phosphorus compounds, benzophenone compounds, siloxane-modified resin, silicone oil, fluororesin particles, polystyrene resin particles, polyethylene resin particles, silica particles, alumina particles, and boron nitride particles.

The average thickness of the protective layer may be 0.5 μm to 10 μm, for example, 1 μm to 7 μm.

The protective layer may be formed by applying a protective layer-forming coating liquid containing the above-described constituents and a solvent to form a coating film, followed by drying and/or curing the coating film. The solvent of the protective layer-forming coating liquid may be an alcohol-based solvent, a ketone-based solvent, an ether-based solvent, a sulfoxide-based solvent, an ester-based solvent, or an aromatic hydrocarbon.

Electrophotographic Apparatus

The electrophotographic apparatus will now be described. As described above, the electrophotographic apparatus of the present disclosure includes the electrophotographic photosensitive member, the charging roller disposed so as to come into contact with the electrophotographic photosensitive member, and a charging device operable to apply only a DC voltage to charge the electrophotographic photosensitive member.

Figure 5:
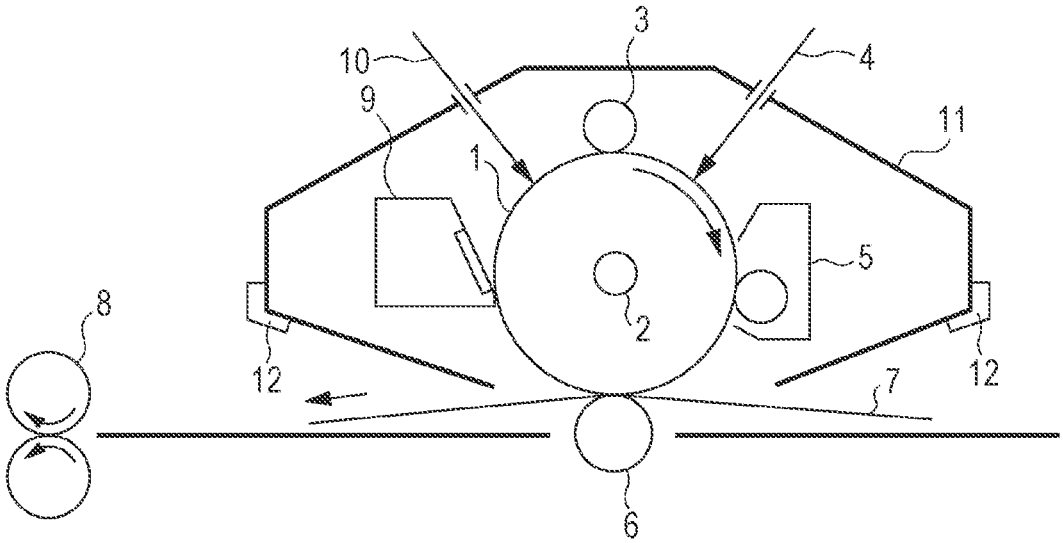
FIG. 5 is a schematic view of an electrophotographic apparatus according to another example embodiment of the present disclosure.

FIG. 5 is a schematic view of the structure of an electrophotographic apparatus provided with a process cartridge including an electrophotographic photosensitive member.

The electrophotographic photosensitive member 1 shown in FIG. 5 is cylindrical (drum-shaped) and is driven for rotation on a shaft 2 in the direction indicated by an arrow at a predetermined peripheral speed (process speed). While the electrophotographic photosensitive member 1 is thus being rotated, the surface (periphery) thereof is positively or negatively charged by the charging device and the charging roller 3. Subsequently, the surface of the electrophotographic photosensitive member 1 is irradiated with exposure light (image exposure light) 4 emitted from an exposure device (image exposure device, not shown). The intensity of the exposure light 4 is modulated according to the time series electrical digital image signal of desired image information. The exposure device may be a slit exposure device or a laser beam scanning exposure device. Thus, an electrostatic latent image corresponding to the desired image information is formed on the surface of the electrophotographic photosensitive member 1.

The electrostatic latent image formed on the surface of the electrophotographic photosensitive member 1 is then developed (normally developed or reversely developed) into a toner image with a toner contained in a developing device 5. The toner image on the surface of the electrophotographic photosensitive member 1 is transferred to a transfer medium 7 by a transfer device 6. If the transfer medium 7 is paper, the transfer medium 7 is fed to the position between the electrophotographic photosensitive member 1 and the transfer device 6 from a paper feeder (not shown) in synchronization with the rotation of the electrophotographic photosensitive member 1. Also, a bias voltage having an opposite polarity to the charge of the toner is applied to the transfer device 6 from a bias source (not shown). The transfer device 6 may be an intermediate transfer medium including a primary transfer member, an intermediate transfer member, and a secondary transfer member.

The transfer medium 7 to which the toner image has been transferred is separated from the surface of the electrophotographic photosensitive member 1 and transported to a fixing device 8, and the toner image is thus fixed. The resulting image-formed item (print or copy) is ejected from the electrophotographic apparatus.

After the toner image has been transferred, the surface of the electrophotographic photosensitive member 1 is cleaned with a cleaning device 9 to remove the residual toner remaining after transfer. The residual toner may be collected by the developing device or the like. Furthermore, the surface of the electrophotographic photosensitive member 1 may be pre-exposed, if necessary, to pre-exposure light 10 from a pre-exposure device (not shown) to remove static electricity before being repeatedly used for forming images.

Some of the components, selected from among the electrophotographic photosensitive member 1, the charging device 3, the developing device 5, the transfer device 6, the cleaning device 9, and other components of the electrophotographic apparatus, may be combined in a single container as an integrated process cartridge. The process cartridge may be removably mounted to the body of the electrophotographic apparatus. For example, the electrophotographic photosensitive member 1 and at least one device selected from among the charging device 3, the developing device 5, the transfer device 6, and the cleaning device 9 are held together to be integrated into a cartridge. The cartridge may be guided by a guide 12 such as a rail, thus being used as a process cartridge 11 removable from the body of the electrophotographic apparatus.

EXAMPLES

The subject matter of the present disclosure will be further described in detail with reference to Examples and Comparative Examples. The subject matter is however not limited to the following Examples. In the following Examples, "part(s)" is on a mass basis unless otherwise specified.

Preparation of Electrophotographic Photosensitive Members

Production Example 1

First, 100 parts of zinc oxide particles (average primary particle size: 35 nm) were mixed with 500 parts of toluene with stirring. To the resulting mixture was added 0.8 part of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-1.

Next, 100 parts of zinc oxide particles (average primary particle size: 50 nm) were mixed with 500 parts of toluene with stirring. To the resulting mixture was added 0.8 part of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-2.

Next, 15 parts of a butyral resin BM-1 (produced by Sekisui Chemical) and 19 parts of a blocked isocyanate resin DURANATE TPA-B80E (nonvolatile content: 80% by mass, produced by Asahi Kasci Chemicals) were dissolved in a mixed solvent of 65 parts of methyl ethyl ketone and 65 parts of 1-butanol. To the resulting solution were added 13 parts of the surface-treated zinc oxide particles P-1, 68 parts of the surface-treated zinc oxide particles P-2, and 0.4 part of 2,3,4-trihydroxybenzophenone (produced by Tokyo Chemical Industry). These materials were dispersed into each other in a sand mill with glass beads of 0.8 mm in diameter at 23° C.±3° C. for 3 hours.

To the dispersion thus prepared were added 0.01 part of silicone oil SH28PA (produced by Dow Corning Toray Silicone) and 5.6 parts of crosslinked poly(methyl methacrylate) (PMMA) particles TECHPOLYMER SSX-103 (produced by Sekisui Chemical, average primary particle size: 3 μm) to yield an undercoat layer-forming coating liquid.

The undercoat layer-forming coating liquid was applied onto a support member by dip coating, and the resulting coating film was dried at 160° C. for 40 minutes to yield a 30 μm-thick undercoat layer.

Subsequently, 20 parts of a crystalline hydroxygallium phthalocyanine (charge generating material) whose CuKα X-ray diffraction spectrum has strong peaks at Bragg angles 2θ (±0.2°) of 7.4° and 28.2°, 0.2 part of a calixarene compound represented by the following formula (A), 10 parts of polyvinyl butyral resin S-LEC BX-1 (produced by Sekisui Chemical), and 600 parts of cyclohexanone were added into a sand mill containing glass beads of 1 mm in diameter. The contents in the sand mill were dispersed in each other for 4 hours. Into the resulting dispersion was added 600 parts of ethyl acetate to yield a charge generating layer-forming coating liquid.

(A)

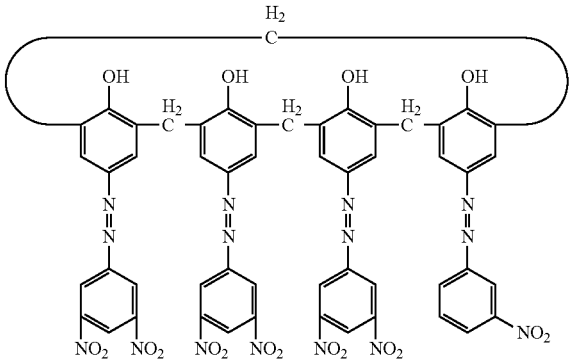

The resulting coating liquid was applied onto the undercoat layer by dip coating. The resulting coating film was dried at 80° C. for 15 minutes to yield a 0.20 μm-thick charge generating layer.

Subsequently, a charge transport layer-forming coating liquid was prepared by dissolving 60 parts of the compound represented by the following formula (B), 30 parts of the compound represented by the following formula (C), 10 parts of the compound represented by the following formula (D), 100 parts of bisphenol Z polycarbonate IUPILON Z400 (produced by Mitsubishi Engineering-Plastics), and 0.2 part of a polycarbonate having the structural unit represented by the following formula (E) (viscosity average molecular weight Mv: 20000) in the mixed solvent of 272 parts of o-xylene, 256 parts of methyl benzoate, and 272 parts of dimethoxymethane.

(B)

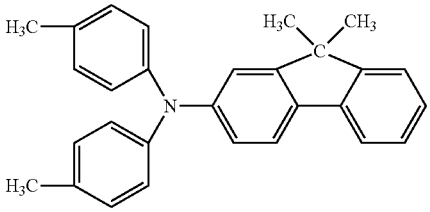

(C)

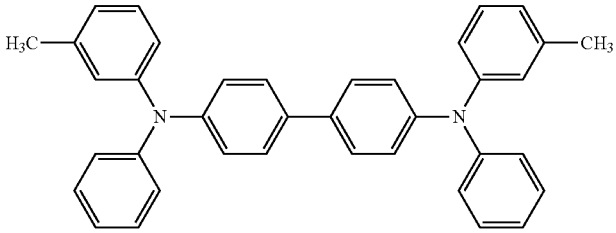

(D)

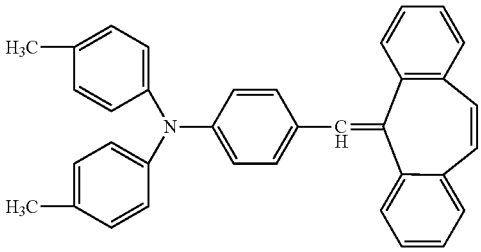

-continued

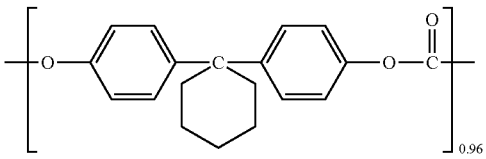

The charge transport layer-forming coating liquid was applied to the surface of the charge generating layer by dip coating. The resulting coating film was dried at 115° C. for 50 minutes to yield an 18 μm-thick charge transport layer.

Next, 1.65 parts of a resin (weight average molecular weight: 130,000) having the structural units represented by formula (F) was dissolved in the mixed solvent of 40 parts of ZEORORA H (1,1,2,2,3,3,4-heptafluorocyclopentane, produced by Zeon Corporation) and 55 parts of 1-propanol. Then, 30 parts of Lubron L-2 (tetrafluoroethylene resin particles, produced by Daikin Industries) was added to the resulting solution, followed by dispersion in a high-pressure disperser Microfluidizer M-110EH (manufactured by US Microfluidics).

(F)

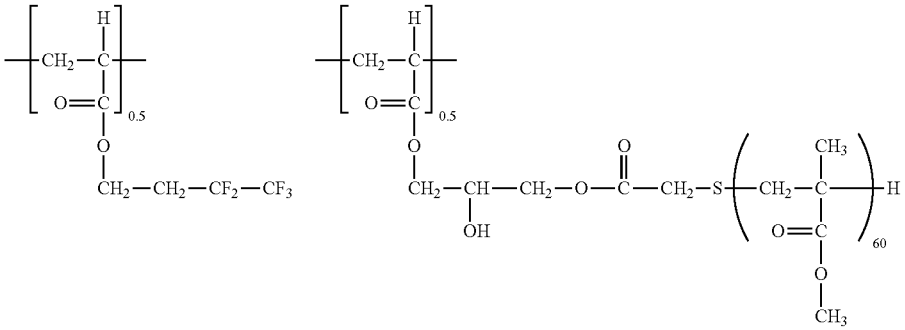

To the resulting dispersion liquid was added 52.0 parts of the hole transporting compound represented by the following formula (G), 2.0 parts of the compound represented by the following formula (H) (produced by Sigma-Aldrich), 16.0 parts of ARONIX M-315 (compound represented by the following formula (1), produced by Toagosci), 0.75 part of siloxane-modified acrylic compound BYK-3550 (produced by BYK), 35 parts of 1,1,2,2,3,3,4-heptafluorocyclopentane, and 15 parts of 1-propanol. The resulting mixture was filtered through a polyflon filter PF-040 (manufactured by ADVANTEC) to yield a protective layer-forming coating liquid.

(G)

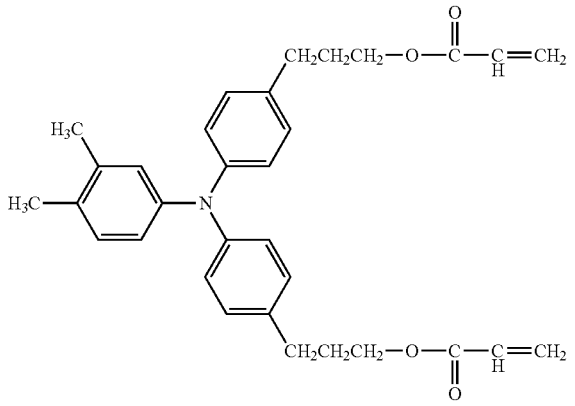

(E)

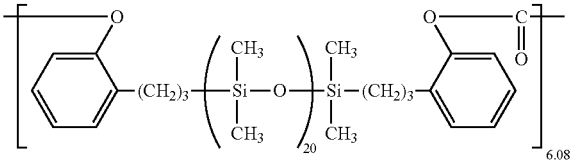

-continued (H)

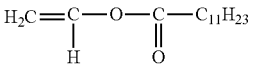

-continued (I)

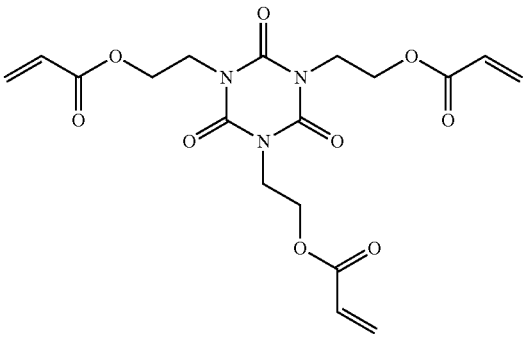

The protective layer-forming coating liquid was applied onto the charge transport layer by dip coating, and the coating film was dried at 40° C. for 5 minutes. After being dried, the coating film was irradiated with electron beam radiation at an acceleration voltage of 70 kV and an absorption dose of 15 kGy for 1.6 s in a nitrogen atmosphere. Then, the coating film was heat-treated in a nitrogen atmosphere for 15 s under the condition where the coating film temperature came to 135° C. The oxygen concentration was 15 ppm in the steps from the electron beam irradiation to the 15-second heat treatment. Subsequently, the coating film was heat-treated for 1 hour in the air under the condition where the coating film temperature came to 105° C., yielding a 5 μm-thick protective layer. Thus, an electrophotographic photosensitive member having a protective layer was produced. This electrophotographic photosensitive member was to be given a surface profile.

Surface Processing of Electrophotographic Photosensitive Member

Figure 7A:
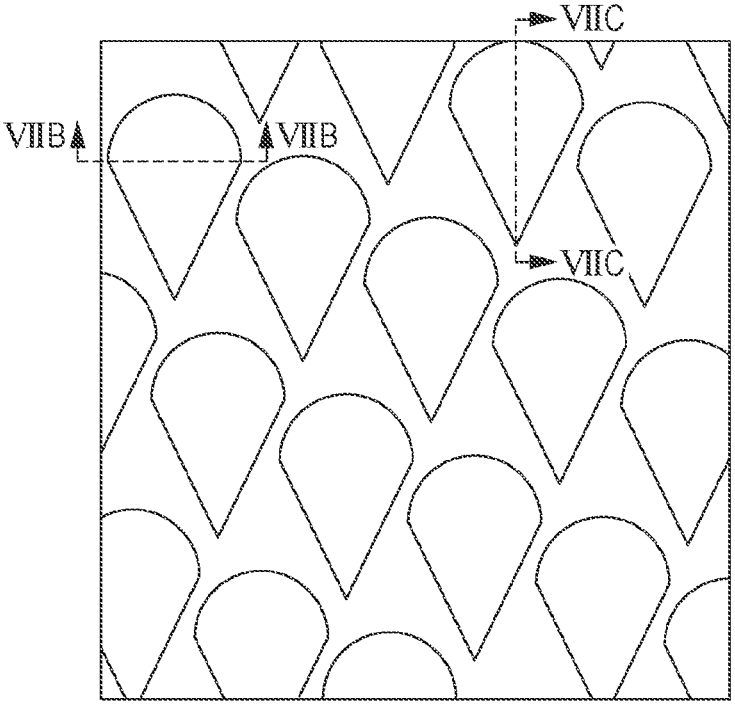
FIG. 7A is a top view of a mold used in the Production Examples of electrophotographic photosensitive members.
Figure 7B:
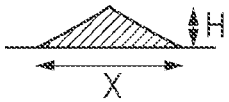
FIG. 7B is a sectional view of the protrusions of the mold shown in FIG. 7A, taken along line VIIB-VIIB.
Figure 7C:
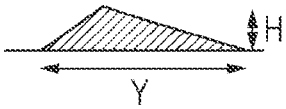
FIG. 7C is a sectional view of the protrusions of the mold shown in FIG. 7A, taken along line VIIC-VIIC.

The periphery of the resulting electrophotographic photosensitive member was processed with a pressure contact-type profile transfer apparatus having the structure generally shown in FIG. 6, equipped with a mold having protrusions generally shown in FIGS. 7A to 7C. In the Examples disclosed herein, each of the protrusions had a maximum width X' (the largest width in the rotational axis direction of the electrophotographic photosensitive member when the protrusion of the mold is viewed from above) of 30 μm, a maximum length Y (the largest length in the circumferential direction of the electrophotographic photosensitive member when the protrusion is viewed from above) of 75 μm, an area ratio of 60%, and a height H of 1.8 μm. The temperature of the mold was controlled so that the periphery of the electrophotographic photosensitive member could be 120° C. during processing, and the electrophotographic photosensitive member and the pressing member were pressed on each other at a pressure of 7.0 MPa while the electrophotographic photosensitive member was being rotated in the circumferential direction. Thus, recesses were formed in and throughout the periphery of the electrophotographic photosensitive member.

The surface of the resulting electrophotographic photosensitive member was observed under a laser microscope X-100 (manufacture by Keyence) at a magnification of 50 times for examination of the profile of the recesses in the surface of the electrophotographic photosensitive member. The observation was controlled so that electrophotographic photosensitive member was not tilted in the longitudinal direction of the electrophotographic photosensitive member and that the vertex of a segment of the electrophotographic photosensitive member could be in focus. A square area 500 μm on a side was obtained by combining images observed under the microscopy with an image combiner application program. The resulting area was subjected to median filter processing at a selected processing height by using an image analysis software supplied with the application program.

The recesses had a depth of 0.9 μm, and the open end of the recesses has a width of 30 μm in the rotational axis direction of the photoelectric photosensitive member, a length (the largest of the lengths of line segments across the open end) of 75 μm in the circumferential direction of the photosensitive member, and an area of 150000 $\mu m^2$. The area mentioned here is the area of the recesses when the electrophotographic photosensitive member was observed from above, that is, the area of the open ends of the recesses. Thus, an electrophotographic photosensitive member having recesses in the periphery thereof was produced.

Thus, such electrophotographic photosensitive members D1, including the undercoat layer, the charge generating layer, the charge transport layer and the protective over the support member and having recesses in the surface thereof, were produced, one each for measuring the cavity volume ratio and for evaluating the properties when mounted in an electrophotographic apparatus.

Production Example 2

Electrophotographic photosensitive members D2 of Production Example 2 were produced in the same manner as in Production Example 1 except that the undercoat layer was formed as described below.

First, 100 parts of zinc oxide particles (average primary particle size: 30 nm) were mixed with 500 parts of toluene with stirring. To the resulting mixture was added 1.0 part of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-3.

Next, 100 parts of zinc oxide particles (average primary particle size: 50 nm) were mixed with 500 parts of toluene with stirring. To the resulting mixture was added 0.5 part of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-4.

Next, 15 parts of a butyral resin BM-1 (produced by Sekisui Chemical) and 19 parts of a blocked isocyanate resin DURANATE TPA-B80E (nonvolatile content: 80% by mass, produced by Asahi Kasei Chemicals) were dissolved in a mixed solvent of 65 parts of methyl ethyl ketone and 65 parts of 1-butanol. To the resulting solution were added 10 parts of the surface-treated zinc oxide particles P-3, 59 parts of the surface-treated zinc oxide particles P-4, and 0.4 part of 2,3,4-trihydroxybenzophenone (produced by Tokyo Chemical Industry). These materials were dispersed into each other in a sand mill with glass beads of 0.8 mm in diameter at 23° C.±3° C. for 3 hours.

To the dispersion thus prepared were added 0.01 part of silicone oil SH28PA (produced by Dow Corning Toray Silicone) and 5.6 parts of crosslinked poly(methyl methacrylate) (PMMA) particles TECHPOLYMER SSX-103 (produced by Sekisui Chemical, average primary particle size: 3 μm) to yield an undercoat layer-forming coating liquid.

The undercoat layer-forming coating liquid was applied onto a support member by dip coating, and the resulting coating film was dried at 170° C. for 40 minutes to yield a 30 μm-thick undercoat layer.

Production Example 3

Electrophotographic photosensitive members D3 of Production Example 3 were produced in the same manner as in Production Example 1 except that the undercoat layer was formed as described below.

First, 100 parts of zinc oxide particles (average primary particle size: 30 nm) were mixed with 500 parts of toluene with stirring. To the resulting mixture was added 3.0 parts of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-5.

Next, 100 parts of zinc oxide particles (average primary particle size: 50 nm) were mixed with 500 parts of toluene with stirring. To the resulting mixture was added 0.2 part of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-6.

Next, 15 parts of a butyral resin BM-1 (produced by Sekisui Chemical) and 19 parts of a blocked isocyanate resin DURANATE TPA-B80E (nonvolatile content: 80% by mass, produced by Asahi Kasei Chemicals) were dissolved in a mixed solvent of 65 parts of methyl ethyl ketone and 65 parts of 1-butanol. To the resulting solution were added 7 parts of the surface-treated zinc oxide particles P-5, 62 parts of the surface-treated zinc oxide particles P-6, and 0.4 part of 2,3,4-trihydroxybenzophenone (produced by Tokyo Chemical Industry). These materials were dispersed into each other in a sand mill with glass beads of 0.8 mm in diameter at 23° C.±3° C. for 3 hours.

To the dispersion thus prepared were added 0.01 part of silicone oil SH28PA (produced by Dow Corning Toray Silicone) and 5.6 parts of crosslinked poly(methyl methacrylate) (PMMA) particles TECHPOLYMER SSX-103 (produced by Sekisui Chemical, average primary particle size: 3 μm) to yield an undercoat layer-forming coating liquid.

The undercoat layer-forming coating liquid was applied onto a support member by dip coating, and the resulting coating film was dried at 155° C. for 40 minutes to yield a 30 μm-thick undercoat layer.

Production Example 4

Electrophotographic photosensitive members D4 of Production Example 4 were produced in the same manner as in Production Example 1 except that the undercoat layer was formed as described below.

First, 100 parts of zinc oxide particles (average primary particle size: 50 nm) were mixed with 500 parts of toluene with stirring. To the resulting mixture was added 3.0 parts of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-7.

Next, 15 parts of a butyral resin BM-1 (produced by Sekisui Chemical) and 19 parts of a blocked isocyanate resin DURANATE TPA-B80E (nonvolatile content: 80% by mass, produced by Asahi Kasei Chemicals) were dissolved in a mixed solvent of 65 parts of methyl ethyl ketone and 65 parts of 1-butanol. To the resulting solution were added 81 parts of the surface-treated zinc oxide particles P-7 and 0.4 part of 2,3,4-trihydroxybenzophenone (produced by Tokyo Chemical Industry). These materials were dispersed into each other in a sand mill with glass beads of 0.8 mm in diameter at 23° C.±3° C. for 3 hours.

To the dispersion thus prepared were added 0.01 part of silicone oil SH28PA (produced by Dow Corning Toray Silicone) and 5.6 parts of crosslinked poly(methyl methacrylate) (PMMA) particles TECHPOLYMER SSX-103 (produced by Sekisui Chemical, average primary particle size: 3 μm) to yield an undercoat layer-forming coating liquid.

The undercoat layer-forming coating liquid was applied onto a support member by dip coating, and the resulting coating film was dried at 165° C. for 40 minutes to yield a 30 μm-thick undercoat layer.

Production Example 5

Electrophotographic photosensitive members D5 of Production Example 5 were produced in the same manner as in Production Example 1 except that the undercoat layer was formed as described below.

First, 15 parts of a butyral resin BM-1 (produced by Sekisui Chemical) and 19 parts of a blocked isocyanate DURANATE TPA-B80E (nonvolatile content: 80% by mass, produced by Asahi Kasei Chemicals) were dissolved in a mixed solvent of 65 parts of methyl ethyl ketone and 65 parts of 1-butanol. To the resulting solution were added 90 parts of the surface-treated zinc oxide particles P-2 and 0.4 part of 2,3,4-trihydroxybenzophenone (produced by Tokyo Chemical Industry). These materials were dispersed into each other in a sand mill with glass beads of 0.8 mm in diameter at 23° C.±3° C. for 3 hours.

To the dispersion thus prepared were added 0.01 part of silicone oil SH28PA (produced by Dow Corning Toray Silicone) and 5.6 parts of crosslinked poly(methyl methacrylate) (PMMA) particles TECHPOLYMER SSX-103 (produced by Sekisui Chemical, average primary particle size: 3 μm) to yield an undercoat layer-forming coating liquid.

The undercoat layer-forming coating liquid was applied onto a support member by dip coating, and the resulting coating film was dried at 155° C. for 40 minutes to yield a 30 μm-thick undercoat layer.

Production Example 6

Electrophotographic photosensitive members D6 of Production Example 6 were produced in the same manner as in Production Example 1 except that the undercoat layer was formed as described below.

First, 100 parts of zinc oxide particles (average primary particle size: 40 nm) were mixed with 500 parts of toluene with stirring. To the resulting mixture was added 0.5 part of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-8.

Next, 100 parts of zinc oxide particles (average primary particle size: 50 nm) were mixed with 500 parts of toluene with stirring. To the resulting mixture was added 1.0 part of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-9.

Next, 15 parts of a butyral resin BM-1 (produced by Sekisui Chemical) and 19 parts of a blocked isocyanate resin DURANATE TPA-B80E (nonvolatile content: 80% by mass, produced by Asahi Kasei Chemicals) were dissolved in a mixed solvent of 70 parts of methyl ethyl ketone and 70 parts of 1-butanol. To the resulting solution were added 31 parts of the surface-treated zinc oxide particles P-8, 74 parts of the surface-treated zinc oxide particles P-9, and 0.4 part of 2,3,4-trihydroxybenzophenone (produced by Tokyo Chemical Industry). These materials were dispersed into each other in a sand mill with glass beads of 0.8 mm in diameter at 23° C.±3° C. for 3 hours.

To the dispersion thus prepared were added 0.01 part of silicone oil SH28PA (produced by Dow Corning Toray Silicone) and 5.6 parts of crosslinked poly(methyl methacrylate) (PMMA) particles TECHPOLYMER SSX-103 (produced by Sekisui Chemical, average primary particle size: 3 μm) to yield an undercoat layer-forming coating liquid.

The undercoat layer-forming coating liquid was applied onto a support member by dip coating, and the resulting coating film was dried at 170° C. for 40 minutes to yield a 30 μm-thick undercoat layer.

Production Example 7

Electrophotographic photosensitive members D7 of Production Example 7 were produced in the same manner as in Production Example 1 except that the undercoat layer was formed to a thickness of 25 μm.

Production Example 8

Electrophotographic photosensitive members D8 of Production Example 8 were produced in the same manner as in Production Example 1 except that the undercoat layer was formed to a thickness of 20 μm.

Production Example 9

Electrophotographic photosensitive members D9 of Production Example 9 were produced in the same manner as in Production Example 1, except that the surface of the undercoat layer was processed with a mold having protrusions having a maximum width X' of 30 μm, a maximum length Y of 75 μm, an area ratio of 60%, and a height H of 6.0 μm to form recesses having a depth of 3.0 μm whose open end has a width of 30 μm in the rotational axis direction and a length (the largest of the lengths of the line segments across the open end) of 75 μm in the circumferential direction.

Production Example 10

Electrophotographic photosensitive members D10 of Production Example 10 were produced in the same manner as in Production Example 1, except that the surface of the undercoat layer was processed with a mold having protrusions having a maximum width X' of 30 μm, a maximum length Y of 75 μm, an area ratio of 60%, and a height H of 7.0 μm to form recesses having a depth of 3.5 μm whose open end has a width of 30 μm in the rotational axis direction and a length (the largest of the lengths of the line segments across the open end) of 75 μm in the circumferential direction.

Production Example 11

Electrophotographic photosensitive members D11 of Production Example 11 were produced in the same manner as in Production Example 1 except that the charge transport layer was formed to a thickness of 10 μm.

Production Example 12

Electrophotographic photosensitive members D12 of Production Example 12 were produced in the same manner as in Production Example 1 except that the charge transport layer was formed to a thickness of 8 μm.

Production Example 13

Electrophotographic photosensitive members D13 of Production Example 13 were produced in the same manner as in Production Example 1 except that the charge transport layer was formed as described below.

A charge transport layer-forming coating liquid was prepared by dissolving 90 parts of the compound represented by formula (B), 10 parts of the compound represented by formula (D), 100 parts of bisphenol Z polycarbonate IUPILON Z400 (produced by Mitsubishi Engineering-Plastics), and 0.2 part of a polycarbonate having the structural unit represented by formula (E) (viscosity average molecular weight Mv: 20000) in the mixed solvent of 272 parts of o-xylene, 256 parts of methyl benzoate, and 272 parts of dimethoxymethane.

The charge transport layer-forming coating liquid was applied to the surface of the charge generating layer by dip coating. The resulting coating film was dried at 115° C. for 50 minutes to yield an 18 μm-thick charge transport layer.

Production Example 14

First, 100 parts of zinc oxide particles (average primary particle size: 35 nm) were mixed with 500 parts of toluene with stirring. To the resulting mixture was added 0.8 part of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-1.

Next, 100 parts of zinc oxide particles (average primary particle size: 50 nm) were mixed with 500 parts of toluene with stirring. To the resulting mixture was added 0.8 part of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-2.

Next, 15 parts of a butyral resin BM-1 (produced by Sekisui Chemical) and 19 parts of a blocked isocyanate DURANATE TPA-B80E (nonvolatile content: 80% by mass, produced by Asahi Kasei Chemicals) were dissolved in a mixed solvent of 65 parts of methyl ethyl ketone and 65 parts of 1-butanol. To the resulting solution were added 13 parts of the surface-treated zinc oxide particles P-1, 68 parts of the surface-treated zinc oxide particles P-2, 0.4 part of 2,3,4-trihydroxybenzophenone (produced by Tokyo Chemical Industry), and 10 parts of 2-butanone oxime (produced by Tokyo Chemical Industry). These materials were dispersed into each other in a sand mill with glass beads of 0.8 mm in diameter at 23° C.±3° C. for 3 hours.

To the dispersion thus prepared were added 0.01 part of silicone oil SH28PA (produced by Dow Corning Toray Silicone) and 5.6 parts of crosslinked poly(methyl methacrylate) (PMMA) particles TECHPOLYMER SSX-103 (produced by Sekisui Chemical, average primary particle size: 3 μm) to yield an undercoat layer-forming coating liquid.

Electrophotographic photosensitive members D14 of Production Example 14 were produced in the same manner as in Production Example 1, except that the undercoat layer was formed by using the undercoat layer-forming coating liquid just described above.

Comparative Production Example d1

Electrophotographic photosensitive members d1 of Comparative Production Example 1 were produced in the same manner as in Production Example 1 except that the undercoat layer was formed as described below.

First, 2.0 parts of a butyral resin BM-1 (produced by Sekisui Chemical) and 2.5 parts of a blocked isocyanate DURANATE TPA-B80E (nonvolatile content: 80% by mass, produced by Asahi Kasei Chemicals) were dissolved in a mixed solvent of 40 parts of methyl ethyl ketone and 40 parts of 1-butanol. To the resulting solution were added 50 parts of zinc oxide particles (average particle size: 70 nm), 20 parts of anatase titanium oxide particles (average particle size: 300 nm), and 0.4 part of 2,3,4-trihydroxybenzophenone (produced by Tokyo Chemical Industry). These materials were dispersed into each other in a sand mill with glass beads of 0.8 mm in diameter at 23° C.±3° C. for 3 hours.

To the dispersion thus prepared were added 0.01 part of silicone oil SH28PA (produced by Dow Corning Toray Silicone) and 5.6 parts of crosslinked poly(methyl methacrylate) (PMMA) particles TECHPOLYMER SSX-103 (produced by Sekisui Chemical, average primary particle size: 3 μm) to yield an undercoat layer-forming coating liquid.

The undercoat layer-forming coating liquid was applied onto a support member by dip coating, and the resulting coating film was dried at 160° C. for 40 minutes to yield a 30 μm-thick undercoat layer.

Comparative Production Example d2

Electrophotographic photosensitive members d2 of Comparative Production Example 2 were produced in the same manner as in Production Example 1 except that the undercoat layer was formed as described below.

First, 100 parts of zinc oxide particles (average primary particle size: 50 nm) were mixed with 500 parts of toluene with stirring. To the resulting mixture was added 2.0 part of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-10.

Next, 100 parts of zinc oxide particles (average particle size: 35 nm) were mixed with 500 parts of toluene with stirring. To the resulting mixture was added 0.2 part of a silane coupling agent KBM 602 (N-2-(aminoethyl)-3-aminopropylmethyldimethoxysilane, produced by Shin-Etsu Chemical), followed by stirring for 6 hours. After the toluene was removed by evaporation under reduced pressure, the sample was dried by heating at 130° C. for 6 hours to yield surface-treated zinc oxide particles P-11.

Next, 15 parts of a butyral resin BM-1 (produced by Sekisui Chemical) and 19 parts of a blocked isocyanate resin DURANATE TPA-B80E (nonvolatile content: 80% by mass, produced by Asahi Kasci Chemicals) were dissolved in a mixed solvent of 70 parts of methyl ethyl ketone and 70 parts of 1-butanol. To the resulting solution were added 37 parts of the surface-treated zinc oxide particles P-10, 68 parts of the surface-treated zinc oxide particles P-11, and 0.4 part of 2,3,4-trihydroxybenzophenone (produced by Tokyo Chemical Industry). These materials were dispersed into each other in a sand mill with glass beads of 0.8 mm in diameter at 23° C.±3° C. for 3 hours.

To the dispersion thus prepared were added 0.01 part of silicone oil SH28PA (produced by Dow Corning Toray Silicone) and 5.6 parts of crosslinked poly(methyl methacrylate) (PMMA) particles TECHPOLYMER SSX-103 (produced by Sekisui Chemical, average primary particle size: 3 μm) to yield an undercoat layer-forming coating liquid.

The undercoat layer-forming coating liquid was applied onto a support member by dip coating, and the resulting coating film was dried at 160° C. for 40 minutes to yield a 30 μm-thick undercoat layer.

Evaluation

Determination of Cavity Volume Ratio

Cavity volume ratios were each determined by calculation from the section image of the undercoat layer of the corresponding electrophotographic photosensitive member. The results are shown in the Table.

Evaluation in Electrophotographic Apparatus

Example 1

Determination of Cavity Volume Ratio

The cavity volume ratio was determined by calculation from the section image of the undercoat layer of one of the electrophotographic photosensitive members D1 produced as described above. The result is shown in the Table.

Calculation of Detection Amount a of Oxime Compound in Undercoat Layer

Another electrophotographic photosensitive member D1 was prepared in the same manner as in Production Example 1 and was subjected to headspace gas chromatography/mass spectrometry (hereinafter referred to as HS-GC/MS measurement) under the conditions described below for calculation of the detection amount A (percent by mass) of the formula (i) compound.

HS-GC/MS Measurement

The protective layer, the charge transport layer and the charge generating layer of the electrophotographic photosensitive member were removed with a wrapping tape C2000 (manufactured by FUJIFILM Corporation) by an electrophotographic photosensitive member tape polishing apparatus manufactured by Canon while the surface of the electrophotographic photosensitive member was being monitored. It should here be noted that the constituents in the protective layer, the charge transport layer and the charge generating layer were not detected by the attenuated total reflection (ATR) technique of FTIR. Next, a test piece of 1 cm (in the circumferential direction of the electrophotographic photosensitive member) by 4 cm (longitudinal direction of the electrophotographic photosensitive member) was cut out of the electrophotographic photosensitive member from which the protective layer, the charge transport layer and the charge generating layer had been removed. The test piece was then placed in a headspace vial, and the vial was sealed with a septum. The sealed headspace vial was heated at 200° C. for 60 minutes to vaporize the formula (i) oxime compound, and the vapor of the oxime compound was subjected to GC/MS measurement to obtain a total ion chromatogram. The peak area of the formula (i) oxime compound was determined from the chromatogram. Subsequently, a calibration curve was prepared by using the formula (i) oxime compound detected by the headspace method as a reference material, and detection amount A (percent by mass) of the formula (i) oxime compound was calculated from the peak area.

Pretreatment Conditions

Headspace sampler: TurboMatrix HS 40 (manufactured by PerkinElmer)

Extraction: 200° C., 60 min.

GC/MS Measurement Conditions

GC: TRACEGCULTRA (manufactured by Thermo Fisher Scientific)

MS: ISQ

Separation column: HP-5MS (60 m×0.25 mm in internal diameter (ID), 0.25 μm in film thickness (Df))

Column temperature: kept at 40° C. for 3 minutes, then heated up to 70° C. at a rate of 2° C./min, further heated up to 150° C. at a rate of 5° C./min, heated up to 300° C. at a rate of 10° C./min, and then kept at 300° C. for 1 minutes.

Ion chamber temperature: 280° C.

GC/MS interface temperature: 280° C.

Carrier gas: He 150 kPa

Ionization mode: EI, 70 eV

Scan range: mass number m/z=40 to 460

Injection: split (split flow rate: 10 mL/min, column flow: 1 mL)

The calculation result of the detection amount A of the formula (i) oxime compound is shown in the Table.

Evaluation of in Electrophotographic Apparatus

For evaluating the electrophotographic photosensitive member mounted in an electrophotographic apparatus, a copy machine modified from imageRUNNER ADVANCE C5560 manufactured by Canon was used as the test apparatus. For charging the electrophotographic photosensitive member, a DC voltage was applied to a contact charging member in the form of a roller (charging roller). The electrophotographic photosensitive member D1 produced in Production Example 1 was mounted in the test apparatus in the environment of 15° C. in temperature and 10% RH in humidity for the following tests.

Uniformity of Development Potential

The voltage applied to the charging roller was adjusted so that the dark portion of the electrophotographic photosensitive member would have a potential of −900 V, and a halftone pattern was output on 10 sheets. The pattern on the 10th sheet was examined to evaluate the uniformity of development potential.

If an irregularity in potential that has occurred during charging remains until development, the toner is not stably developed, resulting in an irregular image. Therefore, the output halftone pattern was checked for irregularity caused by the recesses in the surface of the electrophotographic photosensitive member, and the uniformity of development potential was evaluated from the degree of irregularity in the pattern. The result is shown in the Table.

The uniformity in development potential was rated according to the following criteria:

A: No irregularity caused by the recesses was observed in the output pattern.

B: Irregularity caused by the recesses was slightly observed in the output pattern.

C: Irregularity caused by the recesses was observed in the output pattern.

Leakage

Following the test of nonuniformity in development potential, leakage was tested.

The voltage applied to the charging roller was adjusted so that the dark portion of the electrophotographic photosensitive member would have a potential of −1500 V. After a halftone pattern was repeatedly output on 5000 A4 sheets, the halftone pattern was output on another sheet as a test sample to be examined for evaluation. The result is shown in the Table.

The sample was evaluated in terms of leakage according to the following criteria:

A: No defective portion resulting from leakage was not observed in the sample.

B: Very small black dots resulting from leakage were observed.

C: Black dots resulting from leakage and black streaks extending from the black dots were observed.

D: Black streaks resulting from leakage, extending across the process direction were observed.

Examples 2 to 14

The electrophotographic photosensitive members D2 to D14 were tested for evaluation in the same manner as the electrophotographic photosensitive member D1 was tested in Example 1. The results are shown in the Table.

Comparative Examples 1 and 2

The electrophotographic photosensitive members d1 and d2 were tested for evaluation in the same manner as the electrophotographic photosensitive member D1 was tested in Example 1. The results are shown in the Table.

TABLE

| | Electrophotographic photosensitive member | | | | | | Evaluation | |
|---|---|---|---|---|---|---|---|---|
| | Production Example | Undercoat layer thickness | Total thickness of charge transport layer and overlying layers | Depth of recesses | Cavity volume ratio | Detection among A of oxime compound | Leakage | Uniformity of development potential |
| Example 1 | D1 | 30 μm | 23 μm | 0.9 μm | 0.80% | 0.0120% | A | A |
| Example 2 | D2 | 30 μm | 23 μm | 0.9 μm | 0.46% | 0.0016% | A | A |
| Example 3 | D3 | 30 μm | 23 μm | 0.9 μm | 1.99% | 0.1500% | A | A |
| Example 4 | D4 | 30 μm | 23 μm | 0.9 μm | 0.05% | 0.0080% | A | B |
| Example 5 | D5 | 30 μm | 23 μm | 0.9 μm | 0.03% | 0.1500% | A | C |
| Example 6 | D6 | 30 μm | 23 μm | 0.9 μm | 5.00% | 0.0016% | B | A |
| Example 7 | D7 | 25 μm | 23 μm | 0.9 μm | 0.80% | 0.0120% | A | A |
| Example 8 | D8 | 20 μm | 23 μm | 0.9 μm | 0.80% | 0.0120% | B | A |
| Example 9 | D9 | 20 μm | 23 μm | 3.0 μm | 0.80% | 0.0120% | A | A |
| Example 10 | D10 | 20 μm | 23 μm | 3.5 μm | 0.80% | 0.0120% | A | B |
| Example 11 | D11 | 25 μm | 15 μm | 0.9 μm | 0.80% | 0.0120% | A | A |
| Example 12 | D12 | 25 μm | 13 μm | 0.9 μm | 0.80% | 0.0120% | B | A |
| Example 13 | D13 | 30 μm | 23 μm | 0.9 μm | 0.80% | 0.0120% | A | A |

TABLE-continued

| | Electrophotographic photosensitive member | | | | | | Evaluation | |
|---|---|---|---|---|---|---|---|---|
| | Production Example | Undercoat layer thickness | Total thickness of charge transport layer and overlying layers | Depth of recesses | Cavity volume ratio | Detection among A of oxime compound | Leakage | Uniformity of development potential |
| Example 14 | D14 | 30 μm | 23 μm | 0.9 μm | 0.80% | 0.0300% | A | A |
| Comparative Example 1 | d1 | 30 μm | 23 μm | 0.9 μm | 10.00% | 0.0020% | D | A |
| Comparative Example 2 | d2 | 30 μm | 23 μm | 0.9 μm | 7.00% | 0.0120% | D | A |

The results shown in the Table suggest that the electrophotographic apparatus including a charging device operable to charge an electrophotographic photosensitive member by applying only a DC voltage, and an electrophotographic photosensitive member having discrete recesses in the surface thereof and including an undercoat layer containing zinc oxide particles is less likely to cause leakage when the undercoat layer has a cavity volume ratio of 5.00% or less, compared to the case of the undercoat layer having a cavity volume ratio of 5.00% or more.

While the present invention has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2018-083815 filed Apr. 25, 2018 and No. 2019-072249 filed Apr. 4, 2019, which are hereby incorporated by reference herein in their entirety.

What is claimed is:

1. An electrophotographic apparatus comprising:

an electrophotographic photosensitive member having discrete recesses in the surface thereof;

a charging roller disposed so as to come into contact with the electrophotographic photosensitive member; and a charging device operable to apply only a DC voltage to the charging roller so as to electrically charge the electrophotographic photosensitive member, wherein the electrophotographic photosensitive member includes:

a support member, an undercoat layer over the support member, and a photosensitive layer over the undercoat layer, wherein the undercoat layer contains zinc oxide particles and a binder resin, and the undercoat layer has cavities therein, the cavities accounting for 5.00% or less of the volume of the undercoat layer, and wherein the undercoat layer has thickness of 25.0 μm or more, and wherein a volume average particle size of the zinc oxide particles is 30 nm or more and 50 nm or less.

2. The electrophotographic apparatus according to claim 1, wherein the cavities in the undercoat layer account for 0.05% or more of the volume of the undercoat layer.

3. The electrophotographic apparatus according to claim 1, wherein the cavities in the undercoat layer account for 0.46% to 1.99% of the volume of the undercoat layer.

4. The electrophotographic apparatus according to claim 1, wherein the recesses have a depth of 3.0 μm or less.

5. The electrophotographic apparatus according to claim 1, wherein the photosensitive layer includes a charge generating layer and a charge transport layer, and wherein the total thickness of the charge transport layer and layers overlying the charge transport layer is 15.0 μm or more.

* * * * *